United States Patent [19]

Gianotti et al.

[11] 4,195,709

[45] Apr. 1, 1980

[54] STEP ASSEMBLY FOR CAST STRUCTURES AND METHOD OF INSTALLATION

[76] Inventors: Jerome R. Gianotti, 7236 SE. Reed College Pl.; Thomas J. Hughes, 7535 SE. Reed College Pl., both of Portland, Oreg. 97202

[21] Appl. No.: 958,173

[22] Filed: Nov. 6, 1978

[51] Int. Cl.[2] ..... E04G 15/04; E06C 9/04

[52] U.S. Cl. ..... 182/90; 52/698

[58] Field of Search ..... 182/87, 92, 90; 52/698

[56] References Cited

U.S. PATENT DOCUMENTS

| | | | |
|---|---|---|---|
| 3,200,903 | 8/1965 | Marino | 182/92 |
| 3,299,984 | 1/1967 | Svedahl | 182/92 |
| 3,374,859 | 3/1968 | Dobert | 182/92 |
| 3,974,615 | 8/1976 | Ditcher | 182/92 |

*Primary Examiner*—Reinaldo P. Machado

*Attorney, Agent, or Firm*—James D. Givnan, Jr.

[57] ABSTRACT

A step assembly and method of installing same in cast wall structures is disclosed. Tubular receptacles are disposed in place in the wall structure. Each receptacle has internal and external abutments. A step includes a pair of arms having abutments thereon which cooperate with the internal receptacle abutments to prevent step removal. A modified receptacle is insertable into a completed wall structure.

11 Claims, 9 Drawing Figures

STEP ASSEMBLY FOR CAST STRUCTURES AND METHOD OF INSTALLATION

BACKGROUND OF THE INVENTION

The present invention relates generally to a step assembly including wall implanted receptacles with which the step is insertably engaged after completion of the cast wall.

Known in the prior art are step assemblies disclosing the general concept of embedding within a wall a step socket which is initially held in place by a wall form member. Stripping of the wall form leaves the embedded open socket structure ready for subsequent step installation. A problem exists in accomplishing form separation from the embedded step receptacle. Such is done only after the concrete has set and with the time consuming effort. Examples of such steps may be found in U.S. Pat. Nos. 990,267; 3,299,984; 3,374,859. In each instance the step receiving socket structure must be initially and precisely attached to a form inner surface in a secure manner so as to not be displaced during the subsequent casting operation. Such preliminary placement of the step socket on the form and the following step of detaching the step socket from the reverse or exposed side of the form, prior to form stripping, renders the prior art step assemblies costly in manhour effort in addition to the high per unit cost of the step assemblies. For one reason or another, such prior art step arrangements have not been widely accepted.

SUMMARY OF THE PRESENT INVENTION

The present invention is embodied within a step assembly and the method of step installation.

Step arms are insertable into a pair of receptacles which are positioned within the cast wall by retractable rods slidably supported by a wall form. Each receptacle is adapted for temporary supported engagement with a rod end. Upon curing of the concrete wall, the rods are removal leaving the receptacles in place within the wall. Removal of the forms leaves receptacle ends exposed for subsequent insertion of step arms. The arm and the receptacle have cooperating abutments which coact to prevent step extraction.

The step receptacle is of novel configuration for positioning within the wall structure to receive a step arm in locked manner. The receptacle, during its installation, is in telescopic engagement at one end with the rod end and abuts, at its distal end, the remaining or inner wall form. Said receptacle is formed with an end wall fracturable after form stripping for admission of the step arm. A modified receptacle is adapted to be driven into place with a wall opening formed during wall construction by the extraction of a hold forming rod. Desirably the receptacles are of molded and low unit cost, formed in halves for convenience of molding and joined prior to use.

Important objects include the provision of a method for the rapid installation of step receiving receptacles within a wet or dry cast wall structure; the provision of both a step assembly and a method of installing same which involves only minor changes to existing wall forms, greatly reduces step assembly installation time and permits the latter to be done at the installation site of underground vaults, manholes, etc., to avoid risk to step damage during transit; the provision of a step assembly permanently lockable to the wall structure, and;

the provision of a step assembly and methods of installation compatible with wet and dry casting techniques.

DETAILED DESCRIPTION OF THE PREFERRED EMBODIMENTS

Figure 1:
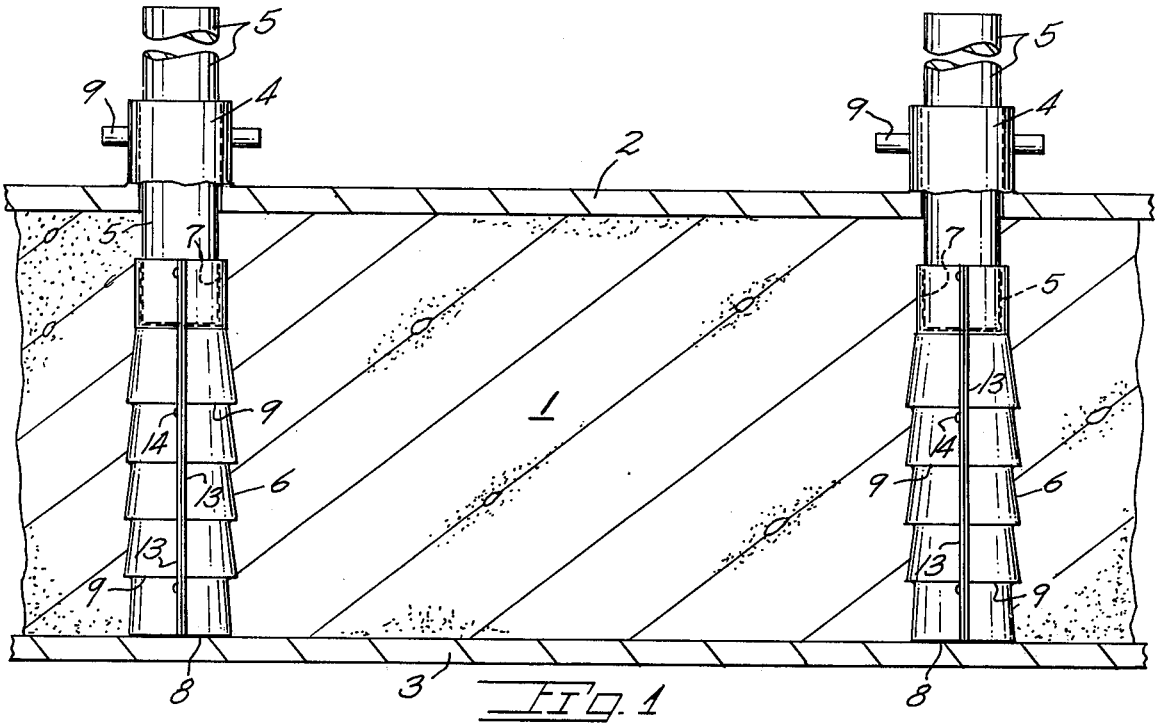
FIG. 1 is a horizontal sectional view of a cast wall structure with step receptacles held in place by extractable rods.

With continuing reference to the drawings, the reference numeral 1 indicates a concrete wall structure which may be straight or curved and part of a manhole, a utility vault, an above ground wall, or other cast structure formed by a wet cast technique. The wall may or may not include reinforcing metal as the present step assembly and methods are usable with or without same.

Indicated at 2 and 3 are outer and inner wall form members termed jacket and core between which concrete is deposited. Rod retention means is shown as a pair of collars 4,4 secured to a form member and slidably receiving inserted rods 5 locked in place by removable pins 9.

Figure 4:
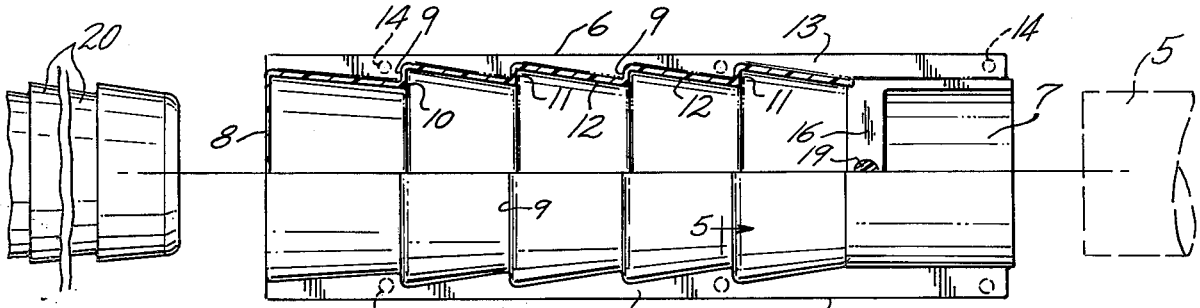
FIG. 4 is a side elevational view of a step receptacle with one quadrant thereof broken away along its lengthwise axis.
Figure 6:
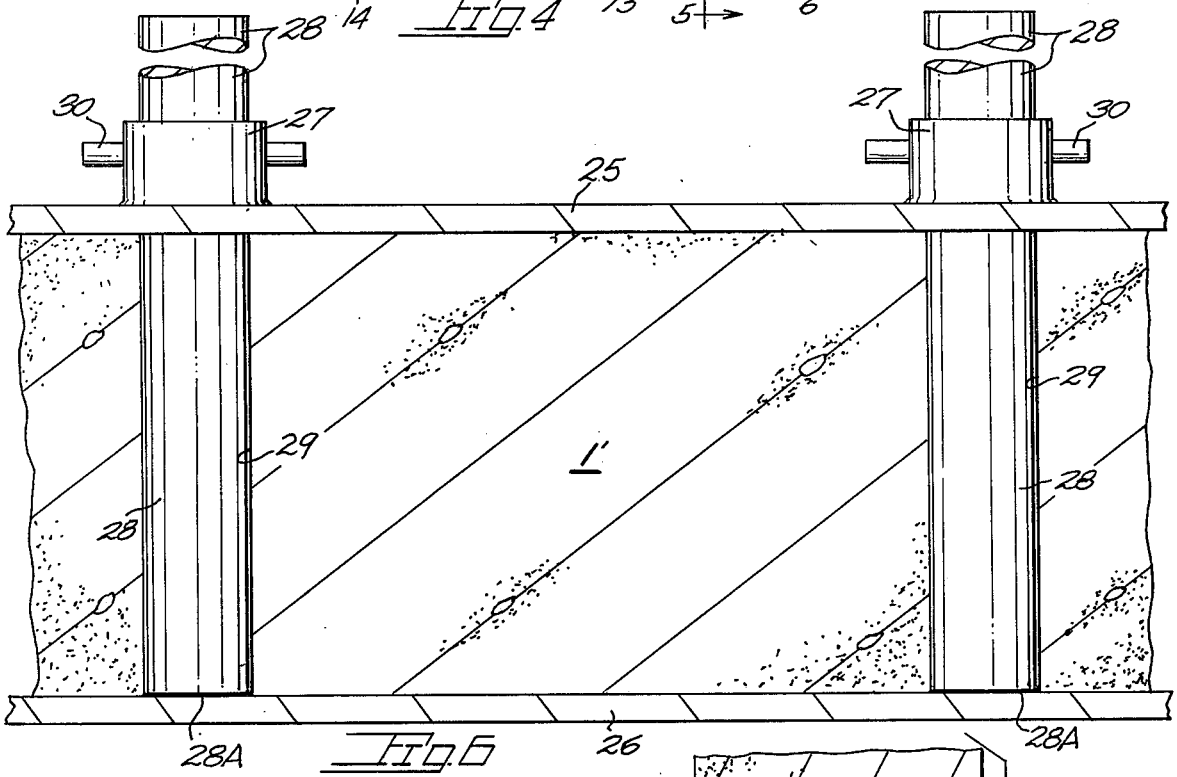
FIG. 6 is a view similar to FIG. 1 but showing hole forming rods used in a modified method of the invention.

With joint reference to FIGS. 1 and 4, receptacles at 6 define a rod receiving, closed end recess 7 formed in one of their ends while a remaining end wall at 8 is adapted for abutting contact against wall inner form member 3. End wall 8 of the receptacle is broken after wall formation for step insertion. Each receptacle includes a series of internal radially extending abutments at 11 shown as annular walls each terminating at a shoulder 10. Truncated conical wall surfaces 12 extend intermediate the abutments. A series of external annular walls are indicated at 9.

Figure 5:
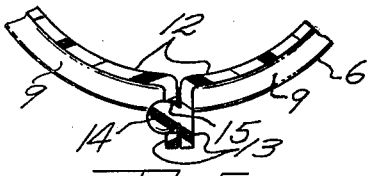
FIG. 5 is a vertical sectional view taken along line 5—5 of FIG. 4 showing receptacle coupling means.

When the receptacle is formed in halves as shown, interengageable means for assembling the halves are provided along flanged sides 13 of each receptacle half in the form of studs 14 (FIG. 5) engageable with openings 15 in the remaining flanged side of the elongate receptacle.

Rod receiving recess 7 of the receptacle is of a length and size to slidably receive a positioning and holding rod 5 in a precise fit to prevent receptacle displacement during wall casting operations. An interior wall 16 closes the end of recess 7. Wall 16 may be provided with additional interengaging means 19 for receptacle assembly.

Figure 2:
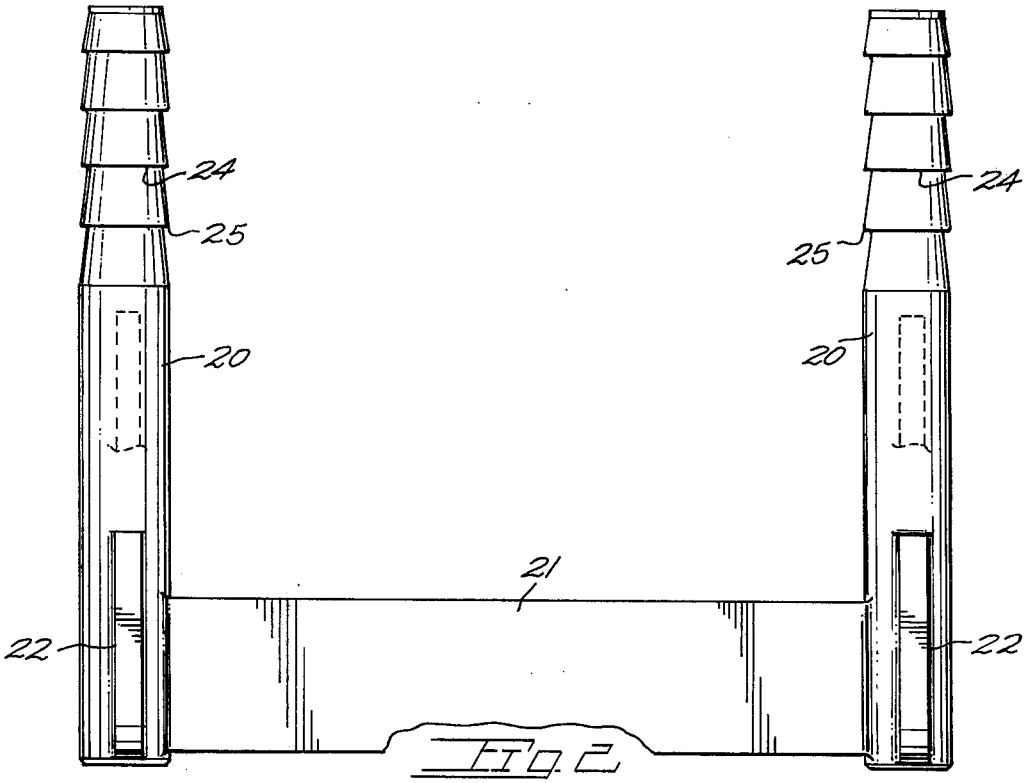
FIG. 2 is a top plan view of a step for inserted engagement with said step receptacles.
Figure 3:
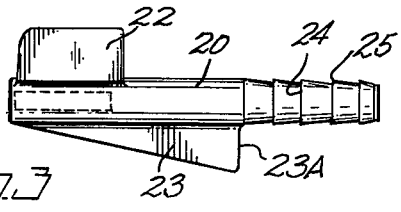
FIG. 3 is a side elevational view of the step on a reduced scale.

The step in FIGS. 2 and 3 has step arms 20,20 joined by a step member 21 with upward projections 22 (FIG. 3) serving to safely confine the user's foot on the step surface. The step is reinforced by a brace 23 extending downwardly from step arms 20 and having a wall contactible front edge 23A. Loads imparted to step member 21 are partially transferred to an abutting concrete wall surface. Each step arm 20 has wall surfaces 24 constituting multiple external abutments which terminate outwardly in a peripheral edge 25. Each surface 24 faces oppositely to the direction of the receptacle abutments. The diameter of edges 25 is such as to permit a sliding fit in one direction past socket shoulders 10 with some yielding of the receptacle.

The method of step assembly installation comprises the steps of positioning parallel rods 5 partially through a first form member. A receptacle 6 is endwise coupled to each rod end. The receptacle distal ends at 8 are positioned so as to be coplanar with the inner surface of a subsequently installed second form member. Deposit of concrete within the form embeds the receptacles. Upon curing of the concrete, the rods 5 are extracted whereafter the form members 2 and 3 are stripped. Insertion of step arms 20,20 into the receptacles lockably secures the step in place. Voids left by rod extraction may be filled by grout applied to the exterior side of the wall formed. The receptacle end walls 8 are fractured or broken by the inserted step arm end or by a separate operation. The abutment surfaces 24 on the step arms and abutting walls 11 of the receptacles serve to prevent accidental outward displacement of the inserted step.

A modified form of the step assembly and method of installation is disclosed in FIGS. 6 through 9 and is compatible with dry cast, no slump concrete using vibration for compaction. Outer and inner wall forms at 25 and 26 are each provided with a collar 27 through which is inserted a hole forming rod 28. Lock pins 30 retain the rods in inserted placement with the inserted rod ends 28A in abutment with the inner surface of the remaining or inner form member. The rods are provided with a lubricant to prevent concrete adherance. Upon casting and at least partial curing of the wall 1', the rods are extracted leaving bores at 29,29 into each of which a modified step arm receptacle 32 is inserted as by driving with a mallet.

The receptacle at 32 is very similar to that first described with the exception that no provision is included for rod end attachment. The receptacle includes a fracturable end wall at 33, and if desired, a closed opposite end at 34. Each receptacle has a series of internal radially extending abutments as at 35 shown as being annular walls and located substantially perpendicular to the receptacle axis and terminate inwardly in shoulders 38. Internal conical wall surfaces are at 36. Flanged sides 37 of each receptacle are provided with studs 39 for passage, during receptacle assembly, through openings in the corresponding half of the receptacle as in the first described receptacle.

Figure 7:
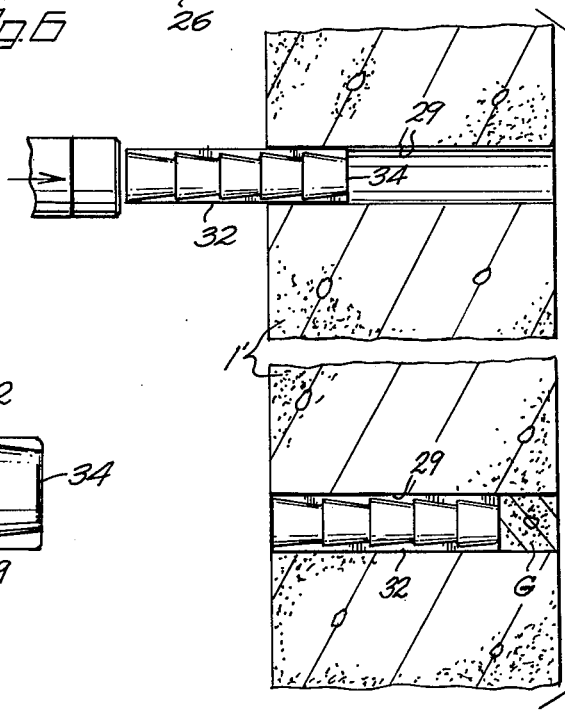
FIG. 7 is a view similar to FIG. 6 but with the rods and form removed and with step arm receptacles being applied to the wall.
Figure 8:
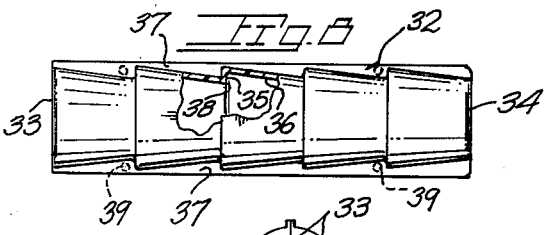
FIG. 8 is a side elevational view of a modified receptacle disclosed in FIG. 7.
Figure 9:
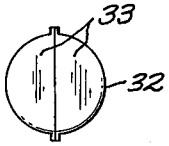
FIG. 9 is an end view taken from the left hand side of FIG. 8.

The receptacles 32 are inserted per FIG. 7 within wall defined openings 29 in the "green" concrete left by extraction of rods 28 which is done prior to form stripping. Remaining voids are filled by grout G or the like which further serves to prevent receptacle extraction. Completion of concrete curing locks the receptacles in place. Step arm insertion completes the installation procedure.

The present step assembly entails but minor modification to existing wall forms. Installation of the receptacles requires but little additional manhour effort. The receptacles utilized may be produced by low cost, high volume molding operations rendering a low per unit cost. Similarly the step may be formed by a molding operation.

In dry cast, no slump concrete operations where the tamping and packerhead processes are used, a hole may be drilled in "green" concrete to receive each receptacle instead of using the hole forming rods.

While we have shown but a few embodiments of the invention it will be apparent to those skilled in the art that the invention may be embodied still otherwise without departing from the spirit and scope of the invention.

Having thus described the invention, what is desired to be secured under a Letters Patent is:

1. A step assembly for installation within a concrete wall structure, said step assembly comprising,
   a pair of receptacles for embedment within the wall structure, each receptacle having yieldable internal multiple abutments facing in one direction, said internal abutments terminating inwardly in shoulders,
   a step having arms for receptacle insertion, each of said arms having multiple external abutments facing in an opposite direction to said receptacle abutments, and
   said external abutments having peripheral edges adapted for passage past said shoulders during arm insertion and thereafter adapted for abutment during attempted arm extraction whereby the arm and step are secured in plce within the wall.

2. The step assembly claimed in claim 1 wherein each of said receptacles also includes external annular walls substantially perpendicular to the receptacle axis.

3. The step assembly claimed in claim 1 wherein each of said receptacles includes an internal wall partially defining a closed end recess at one of its ends to receive a receptacle positioning and holding rod.

4. The step assembly claimed in claim 3 wherein each of said receptacles includes a wall at its remaining end breakable to admit insertion of a step arm.

5. The step assembly claimed in claim 1 wherein said receptacles comprise complementary lengthwise orientated parts, interengageable means on said parts for part assembly.

6. The step assembly claimed in claim 5 wherein said interengageable means comprise studs and openings formed in the receptacle parts.

7. The step assembly claimed in claim 1 wherein said step includes an integral brace having an edge for supported contact with a surface of the wall structure.

8. A method of installing a step within a cast wall structure consisting of the steps of,
   positioning a pair of rods so as to extend transversely through a first wall form member,
   coupling a receptacle endwise to the end of each of said rods,
   installing a second wall form member so as to have the inner surface thereof substantially coplanar with the distal end of each of said receptacles,
   depositing wall material intermediate the form members,
   extracting the rods after setting of the wall material,
   stripping of the wall form members from the cast wall structure, and inserting the arms of a step structure into the wall installed receptacles.

9. The method claimed in claim 8 including the additional step of breaking an end wall at the distal end of each receptacle prior to the step in inserting the arms of a step structure.

10. A method of installing a step within a cast wall structure consisting of the steps of, positioning a pair of rods so as to extend transversely through a first wall form member and through a space defined by said wall form member and a second wall form member to bear against said second wall form member, depositing wall material intermediate the form members, extracting the rods after setting of the wall material, stripping of the wall form members from the cast wall structure, inserting an elongate receptacle into each bore left by an extracted rod, and inserting the arms of a step structure into each of the wall inserted receptacles.

11. The method claimed in claim 10 including the additional step of breaking an end wall at the distal end of each receptacle prior to the step of inserting the arms of a step structure.

* * * * *